US011814977B1

(12) United States Patent
Kessler et al.

(10) Patent No.: US 11,814,977 B1
(45) Date of Patent: Nov. 14, 2023

(54) THERMAL CONDITIONING OF FLANGE WITH SECONDARY FLOW

(71) Applicant: RTX Corporation, Farmington, CT (US)

(72) Inventors: Mason Adam Kessler, Rocky Hill, CT (US); Joon Won Ha, Glastonbury, CT (US); Subhadeep Gan, Middletown, CT (US); Michael Carl Weber, Niantic, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/822,990

(22) Filed: Aug. 29, 2022

(51) Int. Cl.
*F01D 25/24* (2006.01)
*F01D 25/10* (2006.01)

(52) U.S. Cl.
CPC ..... *F01D 25/243* (2013.01); *F01D 25/10* (2013.01); *F05D 2240/14* (2013.01); *F05D 2260/232* (2013.01); *F05D 2260/31* (2013.01)

(58) Field of Classification Search
CPC ..... F01D 25/10; F01D 25/12; F01D 25/243; F05D 2240/14
See application file for complete search history.

(56) References Cited

U.S. PATENT DOCUMENTS

| | | | | |
|---|---|---|---|---|
| 5,127,793 | A * | 7/1992 | Walker | F01D 11/08 415/173.1 |
| 5,593,277 | A * | 1/1997 | Proctor | F01D 11/24 415/173.1 |
| 6,352,404 | B1 | 3/2002 | Czachor et al. | |
| 7,185,499 | B2 | 3/2007 | Chereau et al. | |
| 8,382,432 | B2 | 2/2013 | Grissino et al. | |
| 8,899,051 | B2 | 12/2014 | Rice et al. | |
| 9,206,742 | B2 | 12/2015 | Chuong et al. | |
| 2014/0245751 | A1* | 9/2014 | Chuong | F01D 25/162 60/796 |

FOREIGN PATENT DOCUMENTS

WO WO-2021167001 A1 * 8/2021

* cited by examiner

*Primary Examiner* — Brian O Peters
(74) *Attorney, Agent, or Firm* — CANTOR COLBURN LLP

(57) ABSTRACT

A flange arrangement of a gas turbine engine includes a first flange of a first component, and a second flange of a second component axially offset from the first flange along an engine central longitudinal axis. The first flange is secured to the second flange. One or more flange flowpaths are defined between the first flange and the second flange to convey a flange airflow from an interior of the second component thereby thermally conditioning the flange arrangement. The flange airflow is driven through the one or more flange flowpaths by a pressure differential.

17 Claims, 8 Drawing Sheets

THERMAL CONDITIONING OF FLANGE WITH SECONDARY FLOW

STATEMENT OF FEDERAL SUPPORT

This invention was made with Government support awarded by the United States. The Government has certain rights in the invention.

BACKGROUND

Exemplary embodiments of the present disclosure pertain to the art of gas turbine engines, and more particularly to thermal conditioning of a flange connection of two case elements of gas turbine engines.

Flanges of gas turbine engine cases, when exposed to bypass airflow, have a radial temperature gradient which induces stresses in the case elements. Currently, this issue is currently addressed by installing a separate heat shield across the flange connection, thus insulating the flange connection against the cooling bypass airflow. This keeps the flange connection warm so that the radial temperature gradient is reduced. This heat shield adds weight, cost and complexity to the system, and the degree of effectiveness and consistency of such a solution can be unclear.

BRIEF DESCRIPTION

In one embodiment, a flange arrangement of a gas turbine engine includes a first flange of a first component, and a second flange of a second component axially offset from the first flange along an engine central longitudinal axis. The first flange is secured to the second flange. One or more flange flowpaths are defined between the first flange and the second flange to convey a flange airflow from an interior of the second component thereby thermally conditioning the flange arrangement. The flange airflow is driven through the one or more flange flowpaths by a pressure differential.

Additionally or alternatively, in this or other embodiments an intermediate flange is positioned axially between the first flange and the second flange. The one or more flange flowpaths each include a flowpath opening extending through the intermediate flange to convey the flange airflow from a first side of the intermediate flange to a second side of the intermediate flange.

Additionally or alternatively, in this or other embodiments the one or more flange flowpaths are at least partially defined by a trench formed in the intermediate flange.

Additionally or alternatively, in this or other embodiments the flange airflow is conveyed from an interior of the second component to an interior of the first component.

Additionally or alternatively, in this or other embodiments the first flange is secured to the second flange via a plurality of fastening holes through the first flange and the second flange.

Additionally or alternatively, in this or other embodiments the one or more flange flowpaths are located radially inboard of the plurality of fastening holes.

Additionally or alternatively, in this or other embodiments the flange flowpath extends at least partially circumferentially between a flowpath inlet and a flowpath outlet.

In another embodiment, a case assembly of a gas turbine engine includes a first case having a first case body and a first case flange extending radially outwardly from the first case body relative to an engine central longitudinal axis, and a second case having a second case body and a second case flange extending radially outwardly from the second case body relative to the engine central longitudinal axis. One or more flange flowpaths are defined between the first case flange and the second case flange to convey a flange airflow from an interior of the second case thereby thermally conditioning the first case flange and the second case flange. The flange airflow is driven through the one or more flange flowpaths by a pressure differential.

Additionally or alternatively, in this or other embodiments an intermediate flange is located axially between the first case flange and the second case flange. The one or more flange flowpaths each include a flowpath opening extending through the intermediate flange to convey the flange airflow from a first side of the intermediate flange to a second side of the intermediate flange.

Additionally or alternatively, in this or other embodiments the one or more flange flowpaths are at least partially defined by a trench formed in the intermediate flange.

Additionally or alternatively, in this or other embodiments a first portion of the flange flowpath is defined by a first trench on a first axial side of the intermediate flange, and a second portion of the flange flowpath is defined by a second trench on a second axial side of the intermediate flange.

Additionally or alternatively, in this or other embodiments the first case flange is secured to the second case flange via a plurality of fastening holes through the first case flange and the second case flange.

Additionally or alternatively, in this or other embodiments the one or more flange flowpaths are located radially inboard of the plurality of fastening holes.

Additionally or alternatively, in this or other embodiments the flange flowpath extends at least partially in a circumferential direction between the flowpath inlet and the flowpath outlet.

In yet another embodiment, a gas turbine engine includes a core flowpath and a bypass flowpath. A case assembly includes a first case having a first case body and a first case flange extending radially outwardly from the first case body relative to an engine central longitudinal axis, and a second case having a second case body and a second case flange extending radially outwardly from the second case body relative to the engine central longitudinal axis. One or more flange flowpaths are defined between the first case flange and the second case flange to convey a flange airflow from an interior of the second case thereby thermally conditioning the first case flange and the second case flange. The flange airflow is driven through the one or more flange flowpaths by a pressure differential. The bypass flowpath is located at an exterior of the case assembly, and the core flowpath is located at an interior of the case assembly.

Additionally or alternatively, in this or other embodiments an intermediate flange is located axially between the first case flange and the second case flange. The one or more flange flowpaths each include a flowpath opening extending through the intermediate flange to convey the flange airflow from a first side of the intermediate flange to a second side of the intermediate flange.

Additionally or alternatively, in this or other embodiments the one or more flange flowpaths are at least partially defined by a trench formed in the intermediate flange.

Additionally or alternatively, in this or other embodiments a first portion of the flange flowpath is defined by a first trench on a first axial side of the intermediate flange, and a second portion of the flange flowpath is defined by a second trench on a second axial side of the intermediate flange.

Additionally or alternatively, in this or other embodiments the first case flange is secured to the second case flange via a plurality of fastening holes through the first flange and the second case flange.

Additionally or alternatively, in this or other embodiments the one or more flange flowpaths are located radially inboard of the plurality of fastening holes.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
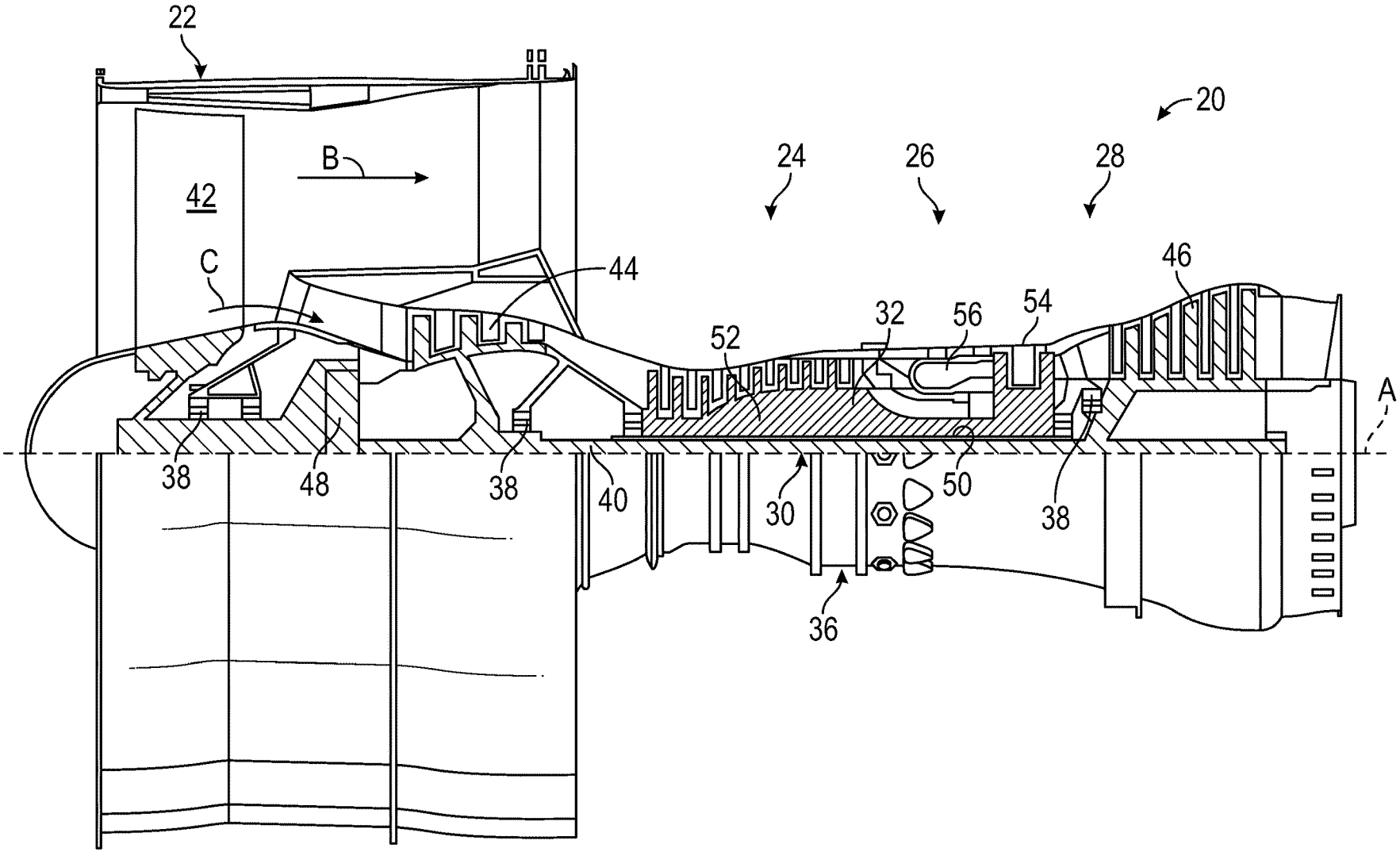
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flowpath B in a bypass duct, while the compressor section 24 drives air along a core flowpath C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
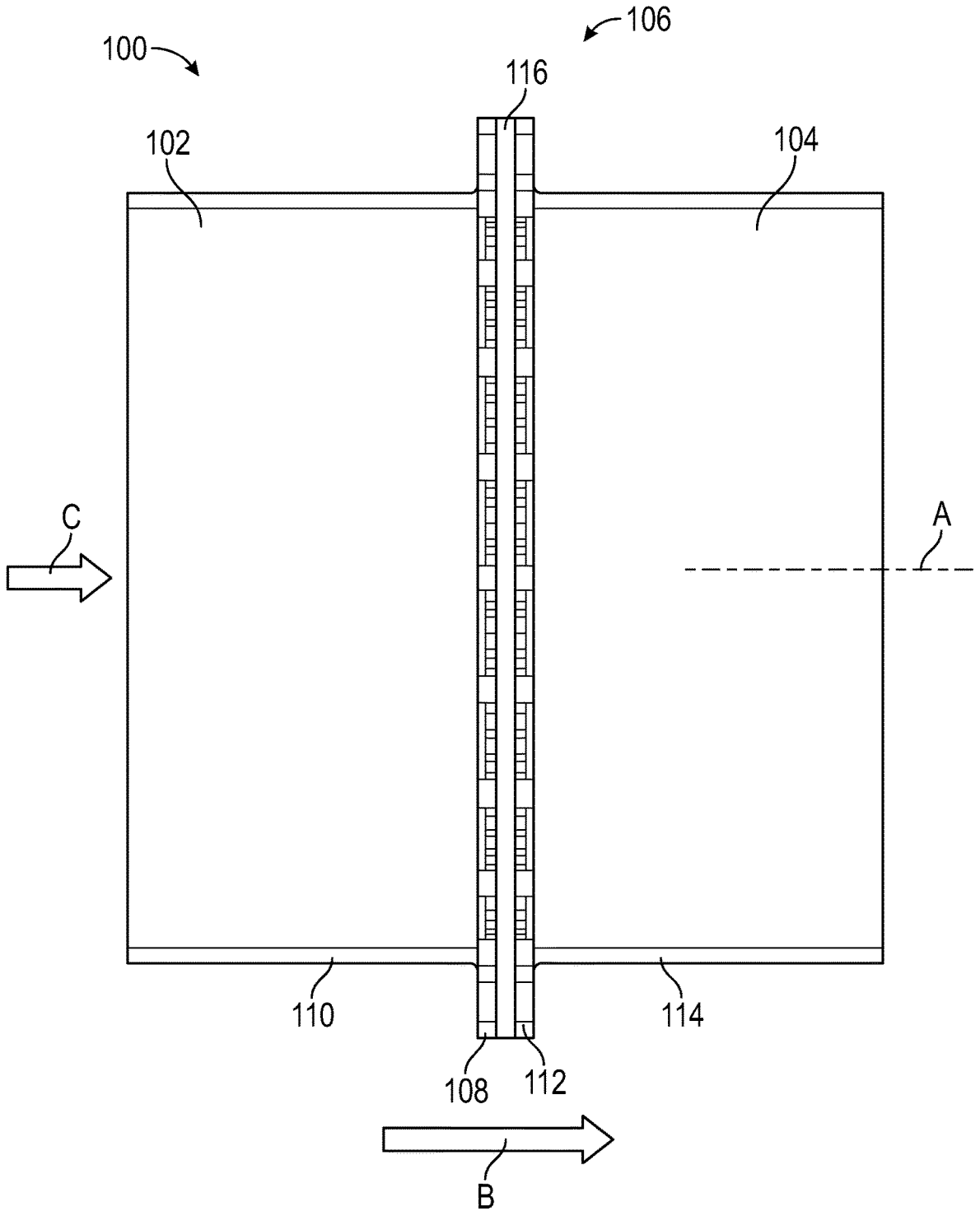
FIG. 2 is a perspective view of an embodiment of a case assembly of a gas turbine engine.

Referring now to FIG. 2, illustrated is a case assembly 100 of an engine 20. The case assembly 100 includes a first case 102 and a second case 104 secured to the first case 102 at a flange arrangement 106. In one embodiment, the first case 102 is a low-pressure compressor case enclosing the low pressure compressor 44 (not shown) and the second case 104 is a high pressure compressor case enclosing the high pressure compressor 52 (not shown). In another embodiment, the first case 102 is a diffuser case enclosing one or more of the high pressure turbine 54 and the low pressure turbine 46 (not shown), and the second case 104 is a combustor case enclosing the combustor 56 (not shown). It is to be appreciated that these embodiments are merely exemplary, and one skilled in the art will readily appreciate that the present disclosure may be readily applied to other case combinations.

The bypass flowpath B is located radially outside of the case assembly 100, while the higher temperature core flowpath C extends through an interior of the case assembly 100. Further, a first operating pressure inside the first case 102 is lower than a second operating pressure inside the second case 104.

Figure 3:
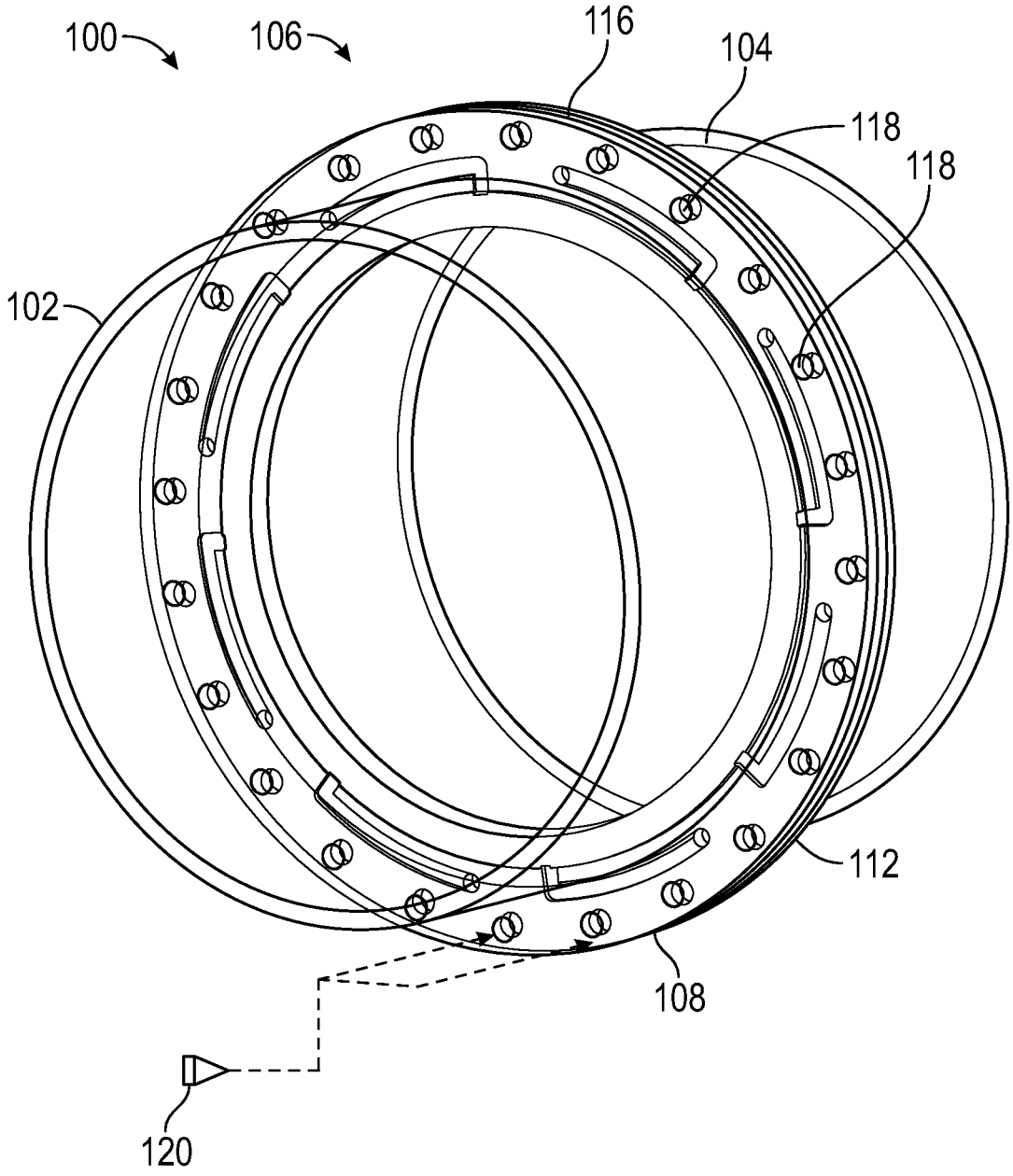
FIG. 3 is another perspective view of an embodiment of a case assembly.

In the embodiment of FIG. 2, the flange arrangement 106 includes a first case flange 108 extending radially outwardly from a first case body 110 of the first case 102 relative to the engine central longitudinal axis A, and a second case flange 112 extending radially outwardly from a second case body 114 of the second case 104 relative to the engine central longitudinal axis A. An intermediate flange 116 is disposed axially between the first case flange 108 and the second case flange 112. In some embodiments, the intermediate flange 116 may be a flange of a third component secured in the flange arrangement 106, or alternatively may merely be a spacer element disposed between the first case 102 and the second case 104. As shown best in FIG. 3, a plurality of fastening holes 118 extend through the first case flange 108, the second case flange 112 and the intermediate flange 116, and a plurality of bolts 120 are installed through the plurality of fastening holes 118 to secure the first case flange 108, the second case flange 112 and the intermediate flange 116 together.

Figure 4:
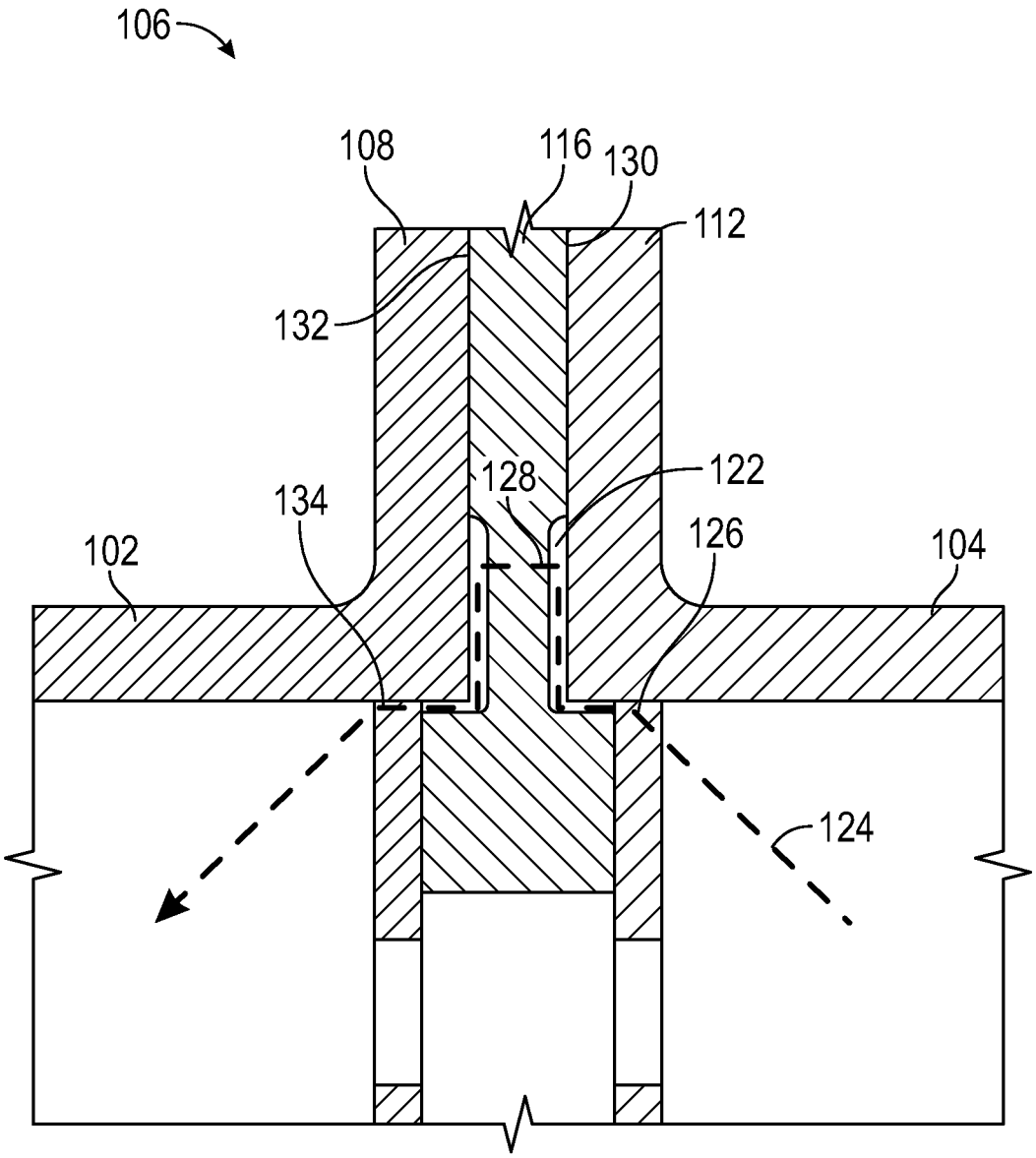
FIG. 4 is a cross-sectional view of an embodiment of a flange flowpath in a flange arrangement.
Figure 5:
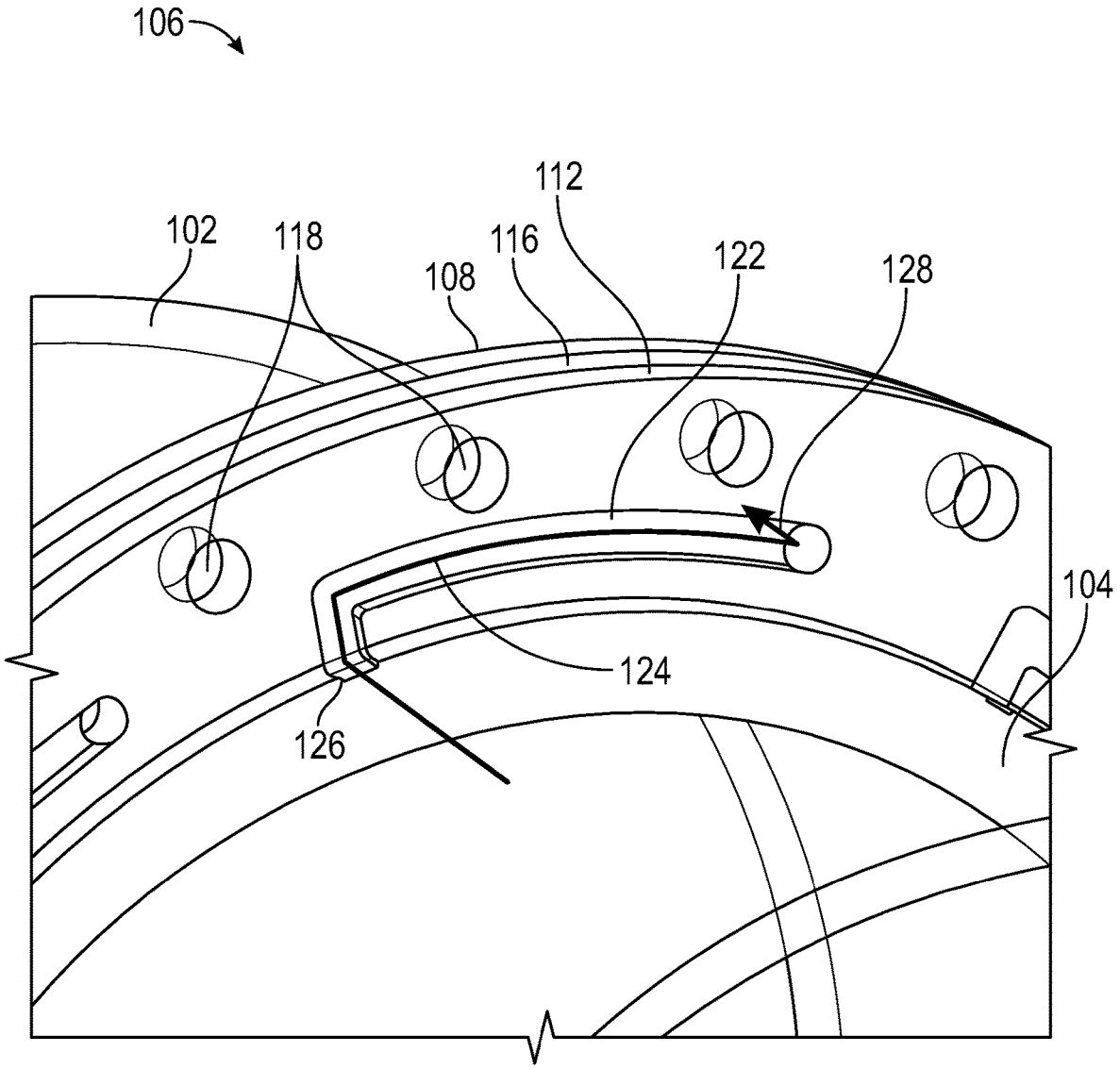
FIG. 5 is a partial perspective view of an embodiment of a flange flowpath in a flange arrangement.

Referring now to FIGS. 4 and 5, one or more flange flowpaths 122 are defined through the flange arrangement 106 through which a flange airflow 124 is directed through the flange arrangement 106 from an interior of the second case 104 into an interior of the first case 102. The flange airflow 124 is driven by a pressure differential between the relatively high second operating pressure and the relatively low first operating pressure. The flange flowpath 122 includes a flowpath inlet 126 defined between the second case 104 and the intermediate flange 116. The flange flowpath 122 extends from the flowpath inlet 126 and in some embodiment is at least partially defined in the intermediate flange 116. In other embodiments, the flange flowpath 122 is defined entirely in the first case 102 and the second case 104. The flange flowpath 122 extends through a flowpath opening 128 in the intermediate flange 116 from a first side 130 of the intermediate flange 116 to a second side 132 of the intermediate flange 116. In some embodiments, the flowpath opening 128 and the flange flowpath 122 are radially offset from the fastening holes 118, for example, located radially inboard of the fastening holes 118. From the flowpath opening 128, the flange flowpath 122 extends to a flowpath outlet 134 defined between the first case 102 and the intermediate flange 116. As shown in FIG. 5, the flange flowpath 122 extends at least partially circumferentially along the intermediate flange 116 between the flowpath inlet 126 and the flowpath opening 128. Further, in some embodiments, the flange flowpath 122 extends at least partially circumferentially along the intermediate flange 116 between the flowpath opening 128 and the flowpath outlet 134. Directing this relatively hot flange airflow 124 along the flange flowpath 122 conditions the flange arrangement 106 by reducing the cooling effects of the bypass airflow on the first flange 102, the second flange 104 and the intermediate flange 116.

Figure 6:
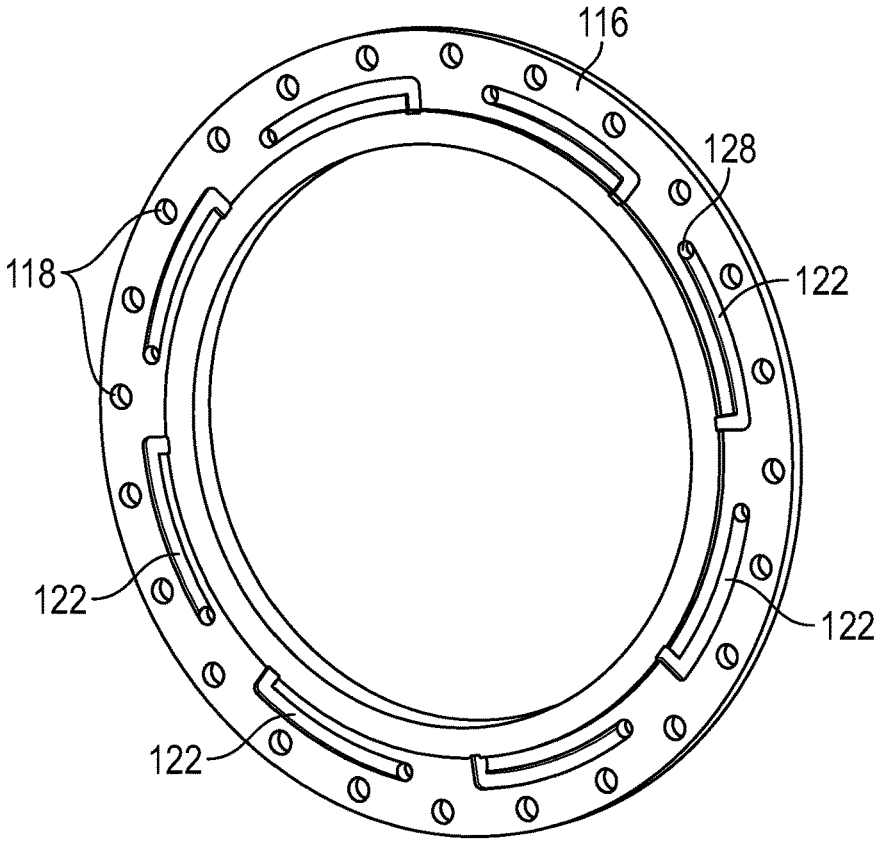
FIG. 6 is a perspective view of an embodiment of an intermediate flange including a plurality of flange flowpaths.
Figure 7:
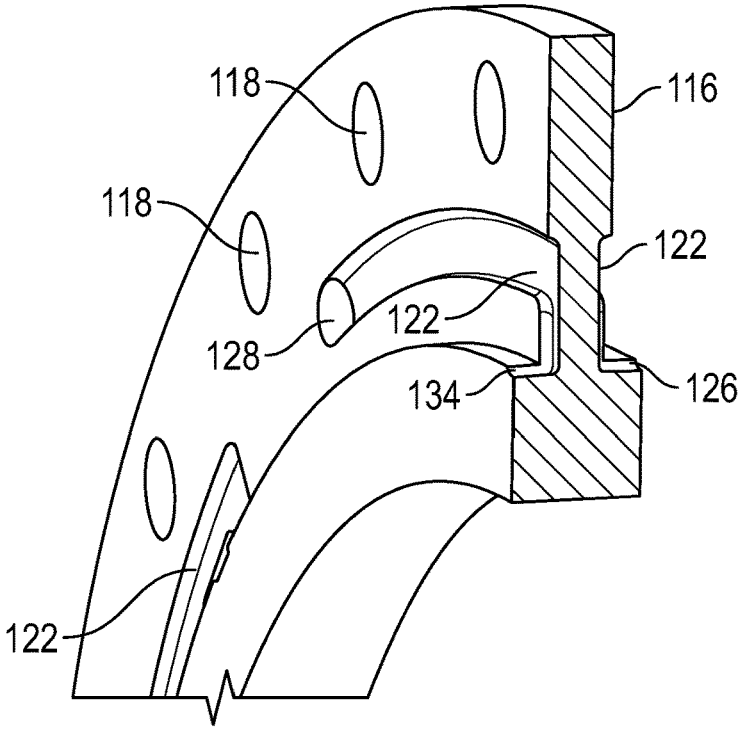
FIG. 7 is a partial cross-sectional view of an embodiment of an intermediate flange.

Referring now to FIGS. 6 and 7, illustrated is an embodiment of an intermediate flange 116. In the illustrated embodiment, the intermediate flange 116 includes multiple flange flowpaths 122 arranged circumferentially around the intermediate flange 116, for example, eight flange flowpaths 122. Using multiple flange flowpaths 122 allows for distribution of the flange airflow 124 over an increased circumferential portion of the flange arrangement 106. One skilled in the art will readily appreciate that other quantities of flange flowpaths 122, for example, four, six or twelve flange flowpaths 122 may be utilized in other embodiments. While in some embodiments the flange flowpaths 122 are circumferentially equally spaced, in other embodiments the circumferential spacing of the flange flowpaths 122 may be varied to provide a desired flange airflow distribution in the flange arrangement 106. In yet other embodiments a circumferential length of the flange flowpaths 122 may be equal as shown in FIG. 6, while in other embodiments the circumferential length may vary among the plurality of flange flowpaths 122 to provide the desired flange airflow 124 distribution.

In some embodiments, the flange flowpaths 122 extend unidirectionally between the flowpath inlet 126 and the flowpath opening 128, and similarly between the flowpath opening 128 and the flowpath outlet 134. Additionally, the flange flowpaths 122 are defined in some embodiments such that the flange airflow 124 flows in a first circumferential direction between the flowpath inlet 126 and the flowpath opening 128, and in an opposite second circumferential direction between the flowpath opening 128 and the flowpath outlet 134. In other embodiments, the flange airflow 124 may be directed in both the first circumferential direction and the second circumferential direction between the flowpath inlet 126 and one or more flowpath openings 128. As illustrated, for example, in FIG. 7 the flange flowpath 122 is defined as a trench formed in the intermediate flange 116. The trench is formed to a trench depth and a trench width to provide the desired flange airflow 124 through the flange flowpaths 122.

Figure 8:
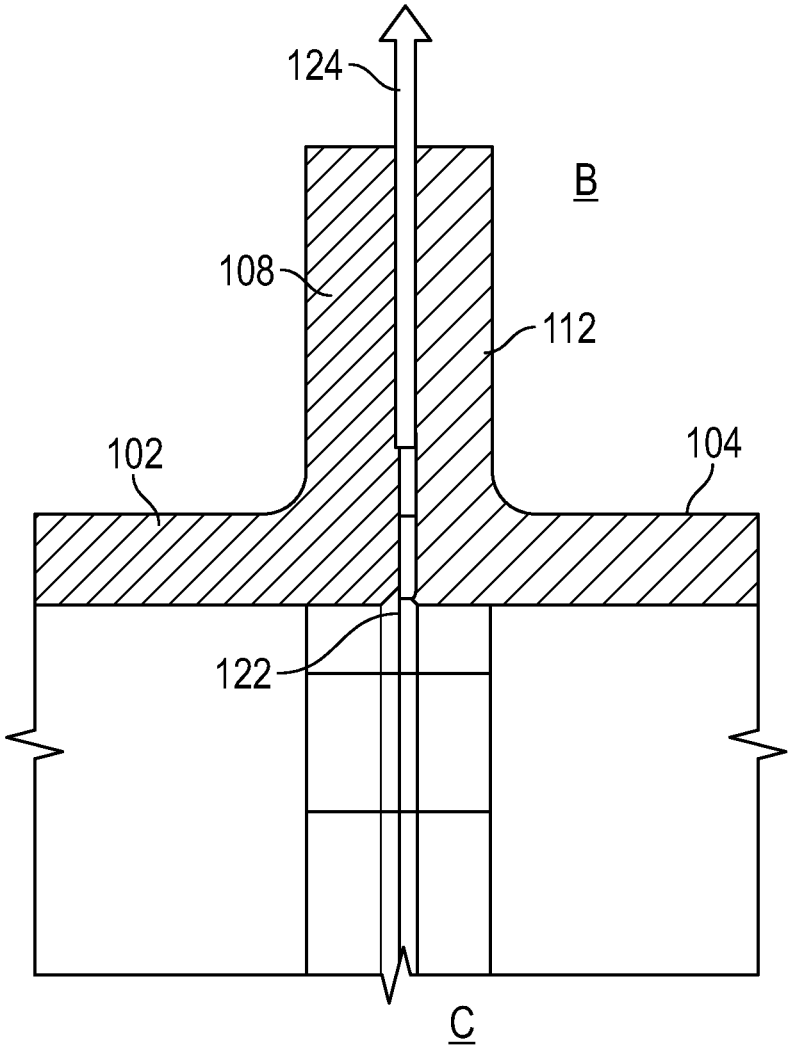
FIG. 8 is a partial cross-sectional view of another embodiment of a flange arrangement.
Figure 9:
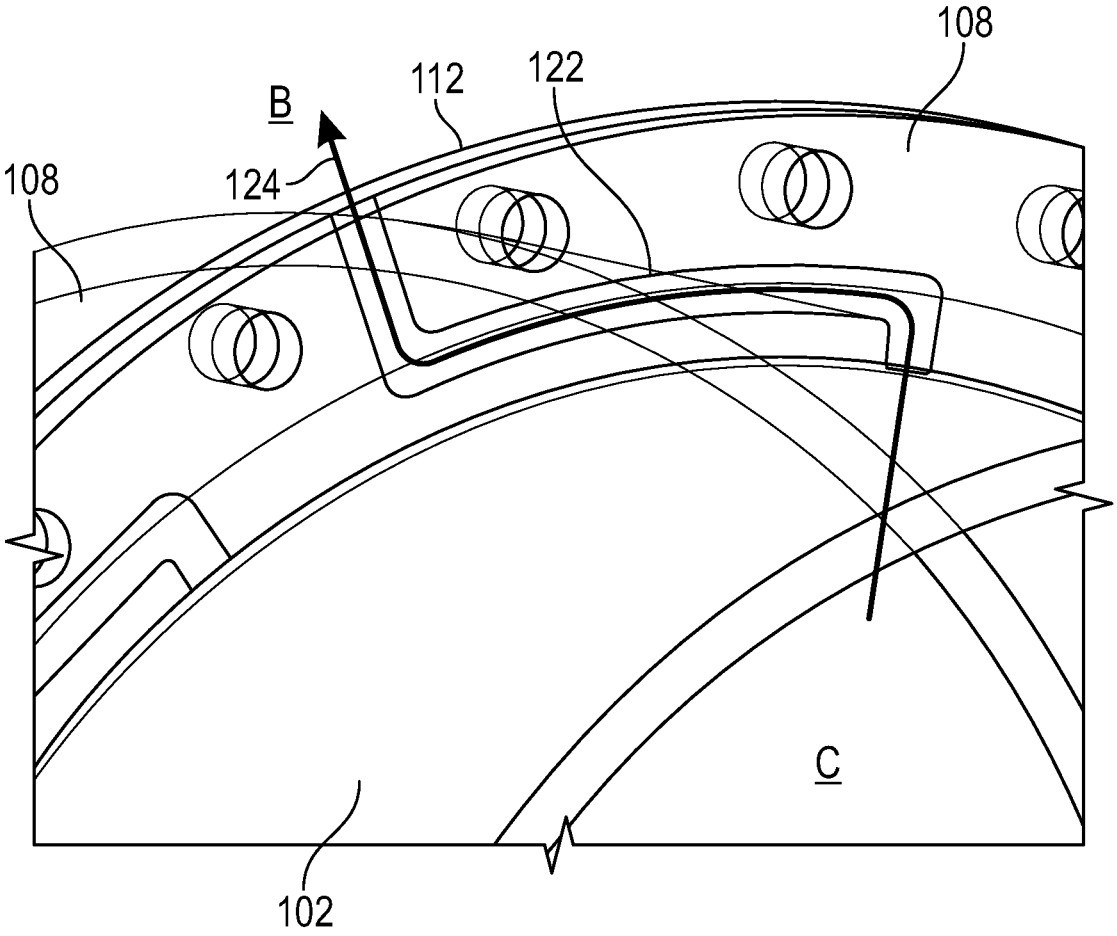
FIG. 9 is a partial perspective view of another embodiment of a flange arrangement.

In another embodiment, as illustrated in FIGS. 8 and 9, the flange arrangement 106 includes the first case flange 108 and the second case flange 112, without and intermediate flange 116. In this embodiment, the flange flowpaths 122 are defined in one or more of the first case flange 108 and the second case flange 112. For example, in some embodiments the flange flowpaths 122 are formed entirely in the first case flange 108. In other embodiments, the flange flowpaths 122 are formed entirely in the second case flange 112. In still other embodiments, the flange flowpaths 122 are formed partially in each of the first case flange 108 and the second case flange 112. In such configurations, the flange airflow 124 flows from an interior of the second case 104 into the bypass flowpath B.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A flange arrangement of a gas turbine engine, comprising:

a first flange of a first component;

a second flange of a second component axially offset from the first flange along an engine central longitudinal axis, the first flange secured to the second flange; and one or more flange flowpaths defined between the first flange and the second flange to convey a flange airflow from an interior of the second component thereby thermally conditioning the flange arrangement, the flange airflow driven through the one or more flange flowpaths by a pressure differential;

wherein the first flange is secured to the second flange via a plurality of fastening holes through the first flange and the second flange;

wherein the one or more flange flowpaths each have a flowpath inlet and a flowpath outlet disposed radially inboard of the plurality of fastening holes.

2. The flange arrangement of claim 1, further comprising an intermediate flange disposed axially between the first flange and the second flange, wherein the one or more flange flowpaths each include a flowpath opening extending through the intermediate flange to convey the flange airflow from a first side of the intermediate flange to a second side of the intermediate flange.

3. The flange arrangement of claim 2, wherein the one or more flange flowpaths are at least partially defined by a trench formed in the intermediate flange.

4. The flange arrangement of claim 2, wherein the flange airflow is conveyed from an interior of the second component to an interior of the first component.

5. The flange arrangement of claim 1, wherein the one or more flange flowpaths are disposed radially inboard of the plurality of fastening holes.

6. The flange arrangement of claim 1, wherein the flange flowpath extends at least partially circumferentially between the flowpath inlet and the flowpath outlet.

7. A case assembly of a gas turbine engine, comprising:

a first case having:

a first case body; and a first case flange extending radially outwardly from the first case body relative to an engine central longitudinal axis;

a second case having:

a second case body; and a second case flange extending radially outwardly from the second case body relative to the engine central longitudinal axis;

one or more flange flowpaths defined between the first case flange and the second case flange to convey a flange airflow from an interior of the second case thereby thermally conditioning the first case flange and the second case flange, the flange airflow driven through the one or more flange flowpaths by a pressure differential;

wherein the first case flange is secured to the second case flange via a plurality of fastening holes through the first case flange and the second case flange;

wherein the one or more flange flowpaths each have a flowpath inlet and a flowpath outlet disposed radially inboard of the plurality of fastening holes.

8. The case assembly of claim 7, further comprising an intermediate flange disposed axially between the first case flange and the second case flange, wherein the one or more flange flowpaths each include a flowpath opening extending through the intermediate flange to convey the flange airflow from a first side of the intermediate flange to a second side of the intermediate flange.

9. The case assembly of claim 8, wherein the one or more flange flowpaths are at least partially defined by a trench formed in the intermediate flange.

10. The case assembly of claim 9, wherein:

a first portion of the flange flowpath is defined by a first trench on a first axial side of the intermediate flange; and a second portion of the flange flowpath is defined by a second trench on a second axial side of the intermediate flange.

11. The case assembly of claim 7, wherein the one or more flange flowpaths are disposed radially inboard of the plurality of fastening holes.

12. The case assembly of claim 7, wherein the flange flowpath extends at least partially in a circumferential direction between the flowpath inlet and the flowpath outlet.

13. A gas turbine engine, comprising:

a core flowpath;

a bypass flowpath; and a case assembly comprising:

a first case having:

a first case body; and a first case flange extending radially outwardly from the first case body relative to an engine central longitudinal axis;

a second case having:

a second case body; and a second case flange extending radially outwardly from the second case body relative to the engine central longitudinal axis;

one or more flange flowpaths defined between the first case flange and the second case flange to convey a flange airflow from an interior of the second case thereby thermally conditioning the first case flange and the second case flange, the flange airflow driven through the one or more flange flowpaths by a pressure differential;

wherein the bypass flowpath is disposed at an exterior of the case assembly; and wherein the core flowpath is disposed at an interior of the case assembly;

wherein the first case flange is secured to the second case flange via a plurality of fastening holes through the first flange and the second case flange;

wherein the one or more flange flowpaths each have a flowpath inlet and a flowpath outlet disposed radially inboard of the plurality of fastening holes.

14. The gas turbine engine of claim 13, further comprising an intermediate flange disposed axially between the first case flange and the second case flange, wherein the one or more flange flowpaths each include a flowpath opening extending through the intermediate flange to convey the flange airflow from a first side of the intermediate flange to a second side of the intermediate flange.

15. The gas turbine engine of claim 14, wherein the one or more flange flowpaths are at least partially defined by a trench formed in the intermediate flange.

16. The gas turbine engine of claim 15, wherein:

a first portion of the flange flowpath is defined by a first trench on a first axial side of the intermediate flange; and a second portion of the flange flowpath is defined by a second trench on a second axial side of the intermediate flange.

17. The gas turbine engine of claim 13, wherein the one or more flange flowpaths are disposed radially inboard of the plurality of fastening holes.

* * * * *